United States Patent [19]

Focke et al.

[11] 4,200,221

[45] Apr. 29, 1980

[54] BLANKS AND STRIPS THEREOF FOR THE FOLDING OF FLIP-TOP CIGARETTE BOXES

[75] Inventors: Heinz Focke; Kurt Liedtke, both of Verden, Fed. Rep. of Germany

[73] Assignee: Focke & Co., Verden, Fed. Rep. of Germany

[21] Appl. No.: 964,026

[22] Filed: Nov. 27, 1978

[30] Foreign Application Priority Data

Jan. 5, 1978 [DE] Fed. Rep. of Germany ..... 2800393

[51] Int. Cl.[2] ..... B65D 5/54; B65D 5/66

[52] U.S. Cl. ..... 229/44 CB

[58] Field of Search ..... 229/44 R, 44 CB

[56] References Cited

U.S. PATENT DOCUMENTS

| | | | |
|---|---|---|---|
| 2,369,387 | 2/1945 | Williamson et al. | 229/44 R |
| 2,824,684 | 2/1958 | Ahlers | 229/44 R |
| 2,951,626 | 9/1960 | Weiss | 229/44 CB |
| 3,282,492 | 11/1966 | Vergobbi | 229/44 CB X |
| 3,942,712 | 3/1976 | Bundy et al. | 229/44 R X |

*Primary Examiner*—Davis T. Moorhead

*Attorney, Agent, or Firm*—Sughrue, Rothwell, Mion, Zinn and Macpeak

[57] ABSTRACT

A blank 10 for the folding of a filp-top cigarette box includes laterally successive surface areas defining a first side wall 16, a front wall 17, a second side wall 18 and a back wall 19 of a main box portion 11. The front and side wall portions 21, 22, 23 of the lid 12 initially lie at an angle above the main box walls, and are connected at one end at a pivot point 42 and at the other end by a bridging portion 41 of a glue strip 20. The space provided by the angling is occupied by a trapezoidal lid reinforcing flap 35 flanked by intermediate punch-out elements 37, 38. During an initial processing step the lid portions are rotated in the plane of the blank about the pivot point and the bridging portion is double folded, to thus bring the lid and main box portions into abutment. Adjacent lines of longitudinally reversed and displaced blanks are laid out on a strip of packaging material with the trapezoidal projections and recesses of their edges interleaved, to thus minimize material waste.

12 Claims, 6 Drawing Figures

Fig.1
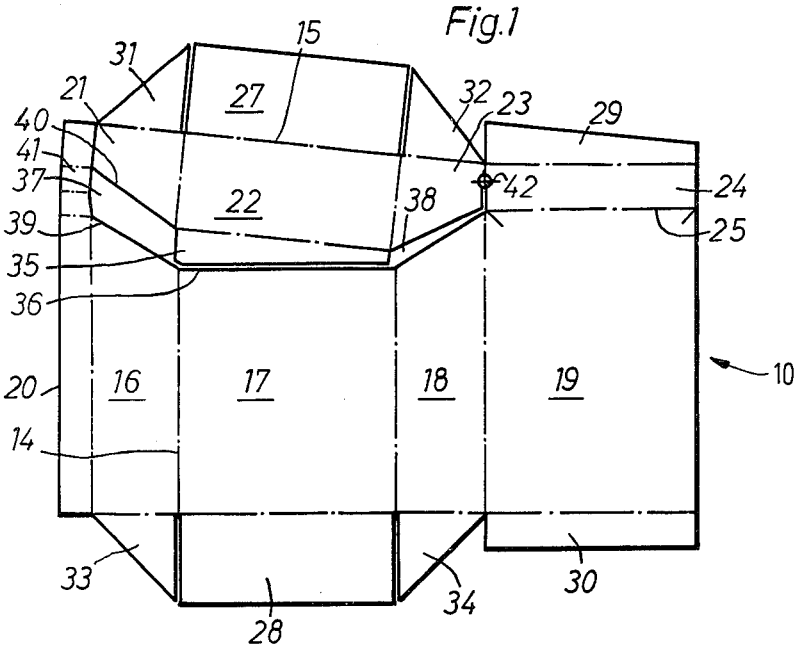
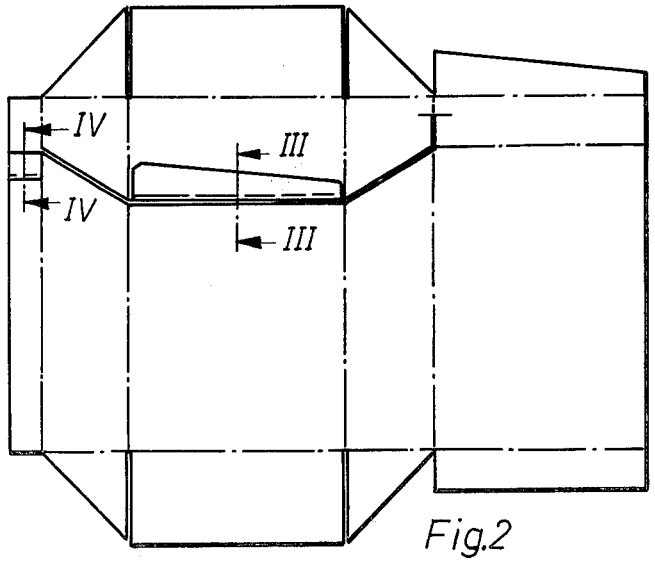
Fig.2
Fig.3
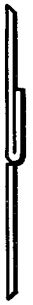
Fig.4
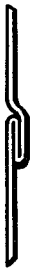

BLANKS AND STRIPS THEREOF FOR THE FOLDING OF FLIP-TOP CIGARETTE BOXES

BACKGROUND OF THE INVENTION

This invention relates to blanks from which folding or flip-top boxes may be folded, such boxes being particularly adapted to accommodate groups of cigarettes, cigarillos or the like.

Flip-top boxes of this type are relatively expensive as compared with conventional "soft" packs owing to the type and amount of material required, whereby many efforts have been made to provide blank layouts and box constructions which reduce the material consumption. In so doing, however, the overall character of the box, and particularly its outer appearance, must be kept substantially intact.

SUMMARY OF THE INVENTION

A basic object of this invention is to provide an improved blank for folding boxes of the flip-top type which minimizes material requirements while at the same time maintaining the outward appearance of a conventional flip-top box. The ease of handling and stability or rigidity characteristics of the resulting box produced from such a blank also remain unchanged. In furtherance of this object the blank is characterized in that the surface areas thereof which define the various walls of the folding lid are successively arranged above the upper edges of the front and side wall elements of the main box portion, but are initially separated therefrom by a reinforcing flap which is ultimately folded inwardly against the front wall of the lid.

Blanks of this type are folded into a finished box according to a principle known in the art as lateral folding. That is, the blank is arranged such that the surface areas which define the front, side and back walls of the main box portion are connected together at their adjacent side edges whereby they may be folded in a wrap-around or tubular manner to arrive at a generally rectangular container shape or configuration. Laterally folded blanks of this type are generally characterized by lower packaging material requirements than are longitudinally folded boxes, this result primarily stemming from the fact that in lateral folding the relatively large area side walls of the box are single layered except in the area of a narrow connecting strip which joins the two opposite edges of the blank together.

A basic aspect of the invention lies in the recognition that a reinforcing flap adapted to be folded inwardly and glued against the lid front wall is an unavoidable structural element in folding boxes of this type in order to provide the lid with the necessary rigidity to withstand repeated opening and closing. The surface area for this reinforcing flap is formed in a blank according to the invention between the front walls of the main box portion and the lid. During an initial folding step the reinforcing flap is separated from the front wall of the main box portion and folded against the lid front wall, and the spaced front and side walls of the main box portion and lid are thereafter brought together by relative movement in the plane of the blank until their free edges meet. This prepares the blank for further folding and processing into its finished box configuration.

The reinforcing flap is trapezoidal in shape and is flanked in the initial blank by similarly shaped intermediate elements which, overall, form a double bent wedge shaped portion which converges adjacent a connecting point between the lid back wall and a lid side wall. After the reinforcing flap is initially folded as described above and the intermediate elements are punched out, the lid portions of the blank are pivoted or rotated about this connecting point and in the plane of the blank to bring the upper edges of the main body portion areas and the lower edges of the lid areas into abuttment.

Blanks of this type are, according to a further feature of the invention, laid out on a strip of packaging material of cardboard or the like in adjacent, oppositely oriented and longitudinally displaced lines with the trapezoidal projections and recesses along their edges meshed or interleaved, to thereby minimize any material waste.

BRIEF DESCRIPTION OF THE DRAWINGS

In the drawings:

FIG. 1 shows a plan view of a spread apart blank immediately after its separation from a strip of packaging material, FIG. 2 shows the blank of FIG. 1 after a first folding step, and in condition for further folding into a finished box, FIG. 3 shows a cross-section taken along line III—III in FIG. 2, on an enlarged scale, FIG. 4 shows a cross-section taken along line IV—IV in FIG. 2, also on an enlarged scale.

DETAILED DESCRIPTION OF THE PREFERRED EMBODIMENT

Figure 6:
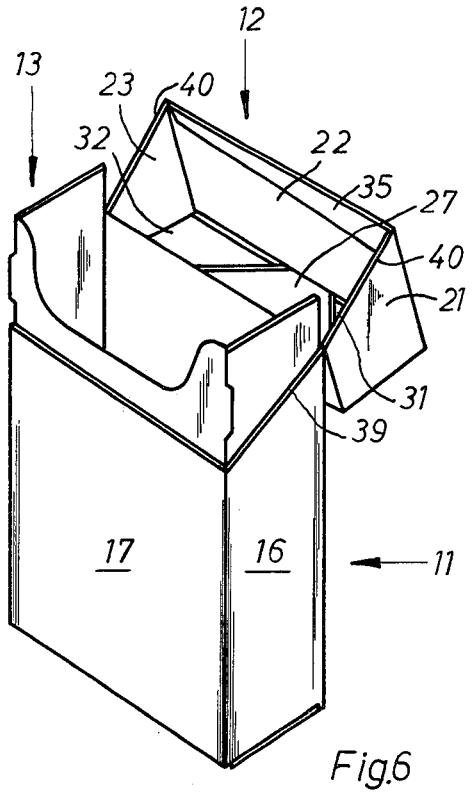
FIG. 6 shows a perspective view of a flip-top box folded from the blank of FIG. 1.

Referring now to the drawings, folding or flip-top boxes as shown in FIG. 6 may be produced by lateral folding from the blanks 10. Such boxes basically consist of a main box portion 11 for receiving a group of cigarettes or the like, a folding lid 12 hingedly connected to the back wall of the main box portion, and a collar 13 formed from a separate blank and extending upwardly out of the open top of the main box portion 11. In the closed position of the box the collar 13 is surrounded on its front and sides by the lid 12.

Each blank 10 presents surface areas defined by longitudinal fold lines 14 and lateral fold lines 15. The successive arrangement of each blank in the lateral direction thus includes a first side wall 16, a front wall 17, a second side wall 18 and a back wall 19. A strip 20 is connected to the outer edge of the first side wall 16, and this strip is joined to the inside of the outer edge of the back wall 19 during folding by glueing or the like, to thus form a rectangular tube or enclosure.

The surface areas of the lid 12 are joined to the surface areas of the main box portion 11 in the direction of the longitudinal fold lines 14. Thus, a lid side wall 21 lies opposite the first side wall 16 of the main box portion, a lid front wall 22 is adjacent the front wall 17, and a lid side wall 23 is adjacent the second side wall 18. A lid back wall 24 is directly connected to the back wall 19 of the main box portion along a hinge axis 25. The upper end of the strip 20 is also connected to the lid side wall 21, and is glued to the lid back wall 24 during folding.

The floor and lid ceiling walls of the box are formed in a similar manner. Thus, a lid ceiling flap 27 is connected to the lid front wall 22, and a main box portion floor flap 28 is joined to the front wall 17. The free edges of these flaps 27, 28 are glued to inner flaps 29, 30 in the finished package, these inner flaps being respectively connected to the lid back wall 24 and the back wall 19. Triangular corner flaps 31, 32 and 33, 34 are folded against and glued to the lid flaps 27, 28 and the inner flaps 29, 30, respectively. The triangular corner flaps 31–34 are arranged such that, together with the adjacent lid flaps 27, 28, they form trapezoidal surfaces.

Figure 5:
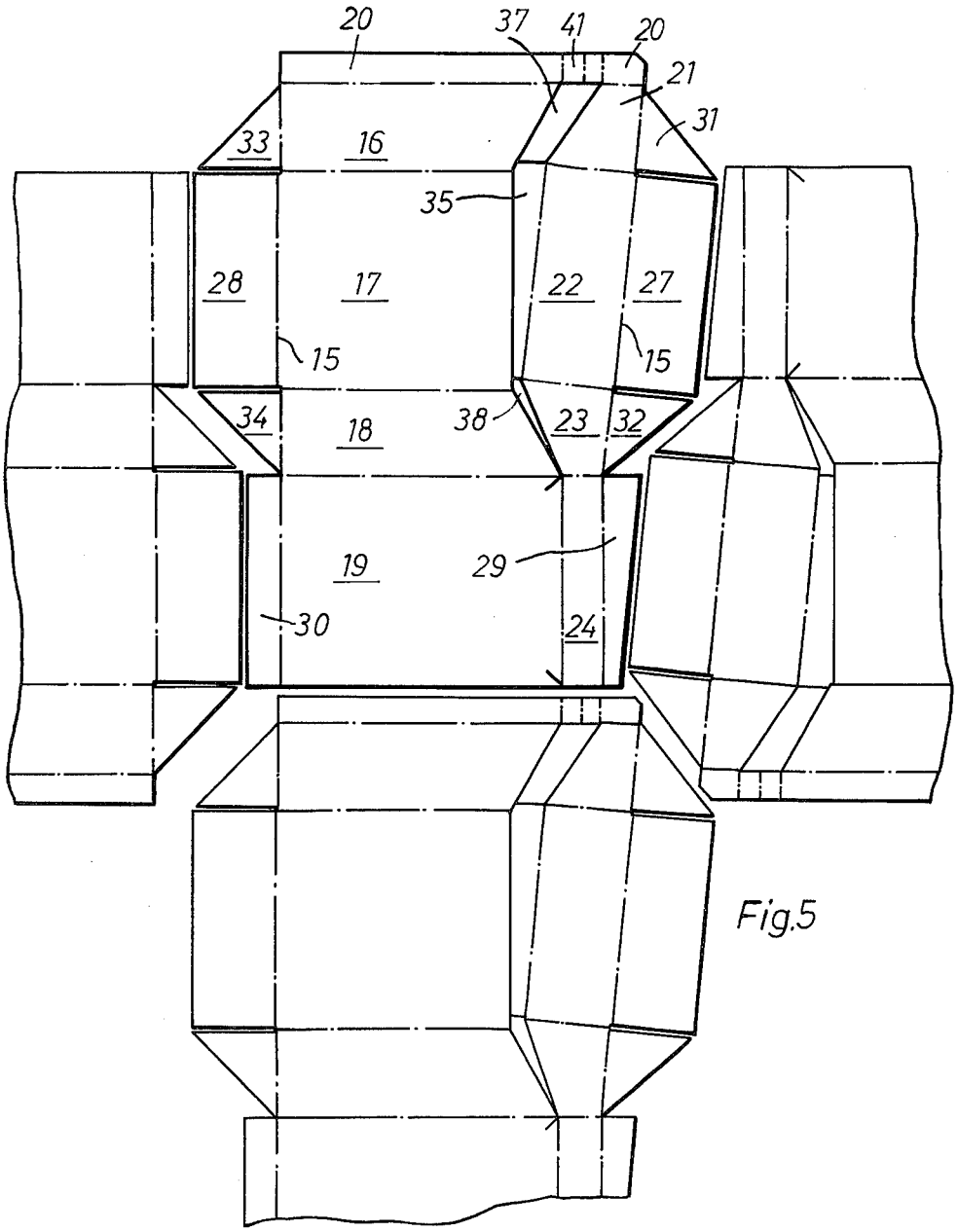
FIG. 5 shows a plan view of a section of packaging material with adjacent lines of blanks laid out in an interleaved arrangement.

The lid front wall 22 is strengthened by a reinforcing flap 35 in the finished box, the flap 35 being connected to the free edge of the lid front wall and folded against the inner side thereof. This reinforcing flap 35 is arranged within the blank 10 as an intermediate element between the lid front wall 22 and the front wall 17 of the main box portion, as seen in FIGS. 1 and 5.

In its initial condition, immediately after separation from the packaging material strip, the blank 10 has the shape shown in FIG. 1 with the trapezoidal reinforcing flap 35 having edges that converge as they approach the back wall 19. A separating cut 36 is made between the flap 35 and the front wall 17, and trapezoidal or wedge shaped intermediate elements 37 and 38 between the side walls 16, 18 and the lid side wall 21, 23 are punched out. These intermediate elements together with the reinforcing flap 35 thus form a wedge-shaped strip in the original blank between the surface areas of the main box portion 11 on one side and those of the lid 12 on the other side, such strip having a double bend to form angled closing edges 39, 40 in the side walls of the finished box in the usual manner.

The strip 20 includes a connecting portion 41 which bridges the gap formed by the punched out intermediate element 37.

After the reinforcing flap 35 is folded inwardly against the lid front wall 22, the upper portion of the blank defining the lid surface areas is pivoted or rotated in a counterclockwise manner until its lower edges abut the upper edges of the front wall 17 and side walls 16, 18 of the main body portion, as best seen in FIG. 2. This rotation takes place about a pivot point 42 located between the lid side wall 23 and the lid back wall 24, and involves some slight plastic or elastic deformation of the packaging material. During such rotation the connecting portion 41 of the strip 20 is doubled over onto itself to form a multiple layer cross-section, as seen in FIG. 4.

The deformation of the packaging material in the vicinity of the pivot point 42 is sufficiently small that the connection between the lid side wall 23 and the lid back wall 24 is not destructively ruptured, and this is assured by compressing the area around the pivot point by support elements during the rotational movement of the lid areas. In any event, after the box blank is completely folded it is transferred into a calibrating device in the form of a closed chamber in a revolving turret. The exact rectangular shaping of the box is implemented in this chamber by the use of heat and pressure.

After the blank 10 has been partially folded as shown in FIG. 2 it is then in a condition for subsequent, complete folding to finally arrive at the finished configuration shown in FIG. 6.

As seen in FIG. 5 the original lines of blanks on the packaging material strip are arranged in a closely interleaved manner to minimize any material waste. Thus, adjacent vertical lines of blanks as viewed in FIG. 5 are longitudinally offset or displaced as well as being oriented in opposite or reverse directions relative to each other. In this manner trapezoidal recesses and projections are formed along the opposite edges of each line of blanks, and these mate or interleave with correspondingly shaped trapezoidal projections and recesses in the adjacent line of blanks.

A further feature of the arrangement of the blanks on the strip of packaging material lies in the fact that the "slanted" lid areas of the blanks in one line lie opposite the correspondingly but reverse slanted lid areas of the blanks in the adjacent line, and the more linear floor flap elements similarly mesh with other floor flap elements in an adjacent line of blanks. Thus, despite the asymmetrical shape of the blanks 10 in their original forms as shown in FIGS. 1 and 5, the overall blank arrangement is still effective to achieve optimum meshing or interleaving and to minimize material waste.

What is claimed is:

1. A blank of packaging material from which a flip-top box for cigarettes or the like may be folded, and including surface areas defining a front, back, side and floor walls of a main box portion, front, ceiling and side walls of a hinged lid portion, and a stiffening flap adapted to be folded against the inside of the lid front wall, characterized by: the surface areas defining a first lid side wall (21), the lid front and ceiling walls (22, 27) and a second lid side wall (23) being arranged in lateral succession opposite and forming an acute angle with, respectively, a first side wall (16), the front wall (17) and a second side wall (18) of the main box portion, a space within said acute angle being occupied by a stiffening flap (35) disposed between the front wall of the main box portion and the lid front wall, and the surface areas defining said first lid side wall, lid front and ceiling walls and second lid side wall being connected to the main box portion at one end by a fold strip (41) and at the other end by a hinge point (42), whereby during folding said lid surface areas and said main box portion surface areas are pivotally moved together about said hinge point to thereby close said acute angle.

2. Blank according to claim 1, wherein the front wall (17) and the lid front wall (22) are connected with each other by the stiffening flap (35), and can be separated from each other by a cut (36) between the reinforcing flap (35) and the front wall (17).

3. Blank according to claim 2, wherein the side walls (16, 18) and the lid side walls (21, 23) are connected with each other by removable intermediate elements (37, 38) flanking the stiffening flap.

4. Blank according to claim 3, wherein after the removal of the intermediate elements (37, 38) the making of the separating cut (36) and the folding of the stiffening flap (35), the surface areas (21, 22, 23, 27, 31, 32) of the lid (12) and the surface areas (16, 17, 18, 28, 33, 34) of the main box portion (11) can be moved toward each other until their free edges meet.

5. Blank according to claim 4, wherein the stiffening flap (35) and the intermediate elements (37, 38) are wedge-shaped.

6. Blank according to claim 5, wherein a connecting strip (20) is connected to the free side of the first side wall (16) and extends into the first lid side wall (21).

7. Blank according to claim 6, wherein the connecting strip (20) includes the fold strip (41) adjacent the intermediate element (37), which is folded into multiple layers as the surface areas are moved together.

8. Blank according to claim 7, wherein the lid ceiling wall and floor wall are formed by outer lid flaps (27, 28) spanning the full width of the box, by narrow inner flaps (29, 30) connected to the lid flaps (27, 28) and by corner flaps (31,32,33,34) which lie on the inside of the lid flaps.

9. Blank according to claim 8, wherein the corner flaps (31–34) are triangular.

10. Blank according to claim 8, wherein the inner flaps (29,30) are connected to the lid back wall (24) and the back wall (19), respectively, whereby the inner flap (29) connected to the lid back wall (24) is formed as a trapezoid.

11. A strip of packaging material carrying blanks according to claim 1, characterized by: the blanks being arranged in an interleaved manner such that projections formed by the lid flaps (27, 28) and corner flaps (31–34) fit into recesses formed by the inner flaps (29,30) and corner flaps of two adjacent blanks.

12. Strip according to claim 11, wherein the respective surface areas defining the lids (12) lie adjacent each other, and are longitudinally displaced to implement interleaving.

* * * * *